US007498732B2

(12) United States Patent
Seon

(10) Patent No.: US 7,498,732 B2
(45) Date of Patent: Mar. 3, 2009

(54) ELECTRON EMISSION DEVICE WITH A GRID ELECTRODE AND ELECTRON EMISSION DISPLAY HAVING THE SAME

(75) Inventor: Hyeong Rae Seon, Buk-gu (KR)

(73) Assignee: Samsung SDI Co., Ltd., Suwon-si (KR)

( * ) Notice: Subject to any disclaimer, the term of this patent is extended or adjusted under 35 U.S.C. 154(b) by 581 days.

(21) Appl. No.: 11/097,097

(22) Filed: Mar. 31, 2005

(65) Prior Publication Data

US 2005/0218789 A1 Oct. 6, 2005

(30) Foreign Application Priority Data

Mar. 31, 2004 (KR) ..... 10-2004-0021940

(51) Int. Cl.
*H01J 1/62* (2006.01)
*H01J 63/04* (2006.01)
*H01J 1/46* (2006.01)

(52) U.S. Cl. ..... 313/497; 313/495; 313/496; 313/293; 313/483; 313/306

(58) Field of Classification Search ..... None
See application file for complete search history.

(56) References Cited

U.S. PATENT DOCUMENTS 5,578,900 A * 11/1996 Peng et al. ..... 313/495
6,224,730 B1 * 5/2001 Rasmussen ..... 313/496
6,515,415 B1 * 2/2003 Han et al. ..... 313/496
7,279,830 B2 * 10/2007 Lee et al. ..... 313/497
2005/0218789 A1 * 10/2005 Seon ..... 313/497
2005/0242706 A1 * 11/2005 Kim et al. ..... 313/497

FOREIGN PATENT DOCUMENTS

JP 2002-110053 4/2002
JP 2003-16978 1/2003
KR 2001-0011791 2/2001
KR 2001-0081497 8/2001

OTHER PUBLICATIONS

Korean Patent Abstract, Publication No. 1020010081497 A, Published on Aug. 29, 2001, in the name of Han et al.
Patent Abstract of Japan, Publication No. 2002-110053, Published on Apr. 12, 2002, in the name of Goren et al.
Patent Abstract of Japan, Publication No. 2003-016978, Published on Jan. 17, 2003, in the name of Hibi.

* cited by examiner

*Primary Examiner*—Sikha Roy
*Assistant Examiner*—Natalie K Walford
(74) *Attorney, Agent, or Firm*—Christie, Parker & Hale, LLP

(57) ABSTRACT

An electron emission device includes: a plate; first and second electrodes insulated from each other and arranged having a predetermined shape; an electron emitter connected to one of the first and second electrodes; and a third electrode formed with a hole through which electrons emitted from the electron emitter pass. The ratio of the a hole width of the third electrode to a width of the electron emitter is equal to or more than about 0.5 and equal to or less than about 1.0. With this configuration, there is no twisting or sagging, thereby satisfying predetermined standards for brightness and color purity.

17 Claims, 6 Drawing Sheets

ELECTRON EMISSION DEVICE WITH A GRID ELECTRODE AND ELECTRON EMISSION DISPLAY HAVING THE SAME

CROSS-REFERENCE TO RELATED APPLICATION

This application claims priority to and the benefit of Korean Patent Application No. 2004-21940, filed Mar. 31, 2004, in the Korean Intellectual Property Office, the entire disclosure of which is incorporated herein by the reference.

BACKGROUND

1. Field of the Invention

The present invention relates to an electron emission device and an electron emission display, and more particularly, to an electron emission device having a grid electrode attached to a lower plate as an under gate structure, and an electron emission display having the same.

2. Discussion of Related Art

Generally, an electron emission device is classified as either a hot cathode type or a cold cathode type, wherein the hot cathode type and the cold cathode type respectively employ a hot cathode and a cold cathode as an electron emission source. A cold cathode type electron emission device includes a structure such as a field emitter array (FEA), a surface conduction emitter (SCE), a metal insulator metal (MIM), a metal insulator semiconductor (MIS), and a ballistic electron surface emitting (BSE).

The electron emission device having the FEA structure is based on the principle that a material having a low work function and a high β-function easily emits electrons due to an electric field difference as an electron emission source in a vacuum. Such an electron emission device having the FEA structure has been developed, which uses a tip structure, a carbon material, or a nano material as the electron emission source.

The electron emission device having the SCE structure includes an electron emitter, wherein a conductive layer is placed on a plate between two electrodes opposite each other and formed with a minute crack or gap, thereby forming the electron emitter. Such an electron emission device is based on the principle that the electron emitter formed by a minute crack or gap emits an electron when electric current due to a voltage applied between two electrodes flows through the surface of the conductive layer.

The electron emission device having an MIM or MIS structure includes an electron emission source having a metal-insulator-metal structure or a metal-insulator-semiconductor structure, and based on the principle that electrons are moved and accelerated from the metal or the semiconductor of high electric potential to the metal of low electric potential when a voltage is applied between the metal and the metal or between the metal and the semiconductor, respectively, thereby emitting the electrons.

The electron emission device having the BSE structure is based on the principle that when the size of a semiconductor is smaller than a mean free path of the electrons contained in the semiconductor electrons travel without sputtering. Such an electron emission device includes an electron supplying layer made of a metal or a semiconductor and formed on an ohmic electrode, an insulator formed on the electron supplying layer, and a thin metal layer formed on the insulator, so that electrons are emitted when voltage is applied between the ohmic electrode and the thin metal layer.

The foregoing electron emission devices are employed for an electron emission display, various backlights, and a lithography electron beam. Among these, the electron emission display includes an electron emission region provided with an electron emission device to emit electrons, and an image displaying region in which the emitted electrons collide with a fluorescent material to emit light. Generally, the electron emission display includes a plurality of electron emission devices formed on a first plate; a driving electrode to control the electron emission of the electron emission devices; a fluorescent layer formed on a second plate which collide with electrons emitted from the first plate; and a focusing electrode to effectively accelerate the electrons toward the fluorescent layer.

Further, in the case of an electron emission display having a triode structure of a cathode electrode, an anode electrode and a gate electrode, an electric field resulting from a predetermined voltage difference applied between the cathode electrode and the gate electrode causes the electron emitter to emit electrons and accelerates the electrons toward the fluorescent layer. Such an electron emission display has high brightness, similar to that of a cathode ray tube (CRT), and a wide view angle.

Referring now to FIG. 1, a conventional electron emission display having an under gate structure will be described. An electron emission display includes a rear plate 11 and a transparent front plate 12, which are opposite to and spaced apart at a predetermined distance by a spacer 13 placed in between. On the rear plate 11 a gate electrode 14 having a stripe pattern, a dielectric layer 15, and a cathode electrode 16 having a stripe pattern transverse to the gate electrode 14, are formed in sequence. Further, an electron emitter 17 is connected to the cathode electrode 16 and emits electrons. Between the cathode electrode 16 connected with the electron emitter 17 and the adjacent cathode electrode 18 is provided a counter electrode 19. The counter electrode 19 is connected to the gate electrode 14 through a hole formed in the dielectric layer 15. As such, the structure that the gate electrode 14 is disposed under the cathode electrode 16 and is called an "under gate structure". On an inner surface of the transparent front plate 12 is formed an anode electrode 20. On the anode electrode 20 is discretely formed a fluorescent layer 21. Between the cathode electrode 16 and the anode electrode 20 is provided a grid electrode 22 for controlling the electrons emitted from the electron emitter 17 to be focused. The grid electrode 22 is supported by the spacer 13 at a predetermined position.

However, in the conventional electron emission display having the foregoing configuration, an annealing process is needed to connect the grid electrode 22, the spacer 13 and the transparent front plate 12 to one another. During the annealing process, the grid electrode 22 is likely to twist due to residual stress. Further, the grid electrode 22 is likely to sag due to its own weight. The twisting and sagging cause the electrons emitted from the electron emitter 17 to collide with the fluorescent layer not the at target area but at an adjacent area, thereby deteriorating color purity of the electron emission display. Therefore, high resolution is hard to achieve.

SUMMARY OF THE INVENTION

In accordance with the present invention an electron emission device is provided with a grid electrode and an electron emission display of an under gate structure having the same, in which the grid electrode is attached to a rear plate having no twist or sag, thereby satisfying a predetermined range of brightness and a predetermined range of color purity.

The forgoing and other aspects of the present invention are achieved by providing an electron emission device including: a plate; first and second electrodes insulated from each other and arranged having a predetermined shape; an electron emitter connected to one of the first and second electrodes; and a third electrode formed with a hole through which electrons emitted from the electron emitter pass, wherein the ratio of the hole width of the third electrode to the width of the electron emitter is equal to or over than about 0.5 and equal to or less than about 1.0.

Another aspect of the present invention is achieved by providing an electron emission display including: a first plate and a second plate opposed to each other; a first electrode and a second electrode insulated from each other and arranged transverse to each other on the first plate, having a predetermined shape; an electron emitter connected to one of the first electrode and the second electrode; a third electrode formed with a hole through which electrons emitted from the electron emitter pass; and an image displaying part including an anode electrode and a fluorescent layer on the second plate, wherein a ratio of the hole width of the third electrode to the width of the electron emitter is equal to or over than 0.5 and equal to or less than 1.0.

According to an aspect of the invention, the ratio of the hole width of the third electrode to the width of the electron emitter is equal to or over than 0.69 and equal to or less than 1.0.

According to another aspect of the invention, the first electrodes and fourth electrodes are formed on the same plane, the fourth electrodes being coupled to the second electrodes through the insulating layer.

According to yet another aspect of the invention, the electron emitter includes a nano tube such as a carbon nano tube (CNT), a nano wire, graphite, diamond-like carbon, silicon (Si), silicon carbide (SiC) or combination thereof.

DETAILED DESCRIPTION

Figure 1:
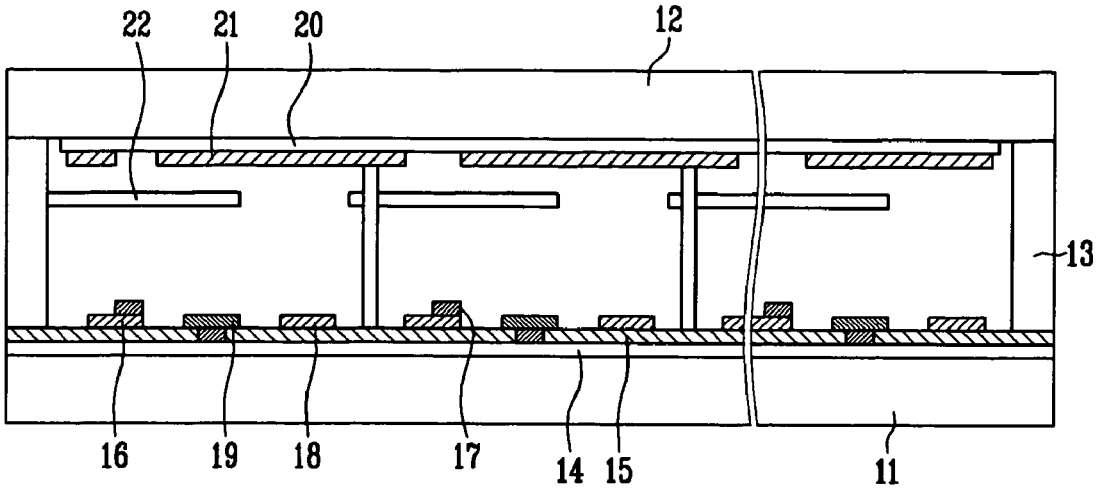
FIG.1 (PRIOR ART)
FIG. 1 is a sectional view of a conventional electron emission display having an under gate structure.

An electron emission display according to a first embodiment of the present invention will now be described with reference to FIGS. 2 through 5, which has an under gate structure with a grid electrode attached to a rear plate assembly. An electron emission device according to a first embodiment of the present invention includes: a plate 31; a gate electrode 32 and a cathode electrode 34 insulated from each other and arranged having a predetermined shape on the plate 31; an electron emitter 35 connected to one of the first and second electrodes 32, 34 and a grid electrode 52 formed with a hole 52*a* through which electrons emitted from the electron emitter 35 pass. The ratio of the horizontal hole width of the grid electrode 52 to the horizontal width of the electron emitter 35 is equal to or more than about 0.5 and equal to or less than about 1.0. The respective widths are in the direction of the cathodes, i.e., the Y direction shown in the drawings.

Further, an electron emission display according to the first embodiment of the present invention includes a rear plate 31 and a front plate 41 opposed to each other. A gate electrode 32 and a cathode electrode 34 are insulated from each other and arranged transverse to each other on the rear plate 31, and have a predetermined shape. An electron emitter 35 is connected to the cathode electrode 34. A grid electrode 52 is formed with a hole through which electrons are emitted from the electron emitter 35 pass. An image displaying part includes an anode electrode 42 and a fluorescent layer 44 on the front plate 41, wherein the ratio of the horizontal hole width of the grid electrode 52 to the horizontal width of the electron emitter 35 is equal to or more than about 0.5 and equal to or less than about 1.0.

In more detail, the electron emission display includes a rear plate 31 and a transparent front plate 41, which are opposed to and spaced from each other by a spacer 51 at a predetermined distance. Gate electrode 32 is made of a conductive material and is formed on the rear plate 31, having a stripe pattern. The rear plate 31 may be a glass plate. A dielectric layer 33 is formed on the gate electrode 32. Cathode electrode 34 is made of a conductive material and formed on the dielectric layer 33, having a stripe pattern transverse to the gate electrode 32. The electron emitter 35 is made of an electron emission material and formed at a lateral side of the cathode electrode 34. Further, a counter electrode 36 is made of a conductive material and formed between the cathode electrode 34 having the electron emitter 35 and the adjacent cathode electrode 34. The counter electrode 36 is connected to the gate electrode 32 through a hole formed in the dielectric layer 33. The electron emitter 35 can include a nano tube such as carbon nano tube (CNT), a nano wire, silicon (Si), silicon carbide (SiC), graphite, diamond-like carbon, or combination thereof. In an exemplary embodiment, the electron emitter 35 may be a carbon nano tube (CNT).

An anode electrode 42 formed on the front plate 41 is formed by a transparent electrode such as indium tin oxide (ITO), which is excellent for optical transmitivity. The fluorescent layer 44 formed on the front plate 41 includes red, green and blue fluorescent layers. The red, green and blue fluorescent layers are in turn arranged as a stripe or matrix shape, leaving a predetermined space in between. Further, an optical interception film (or black layer) 43 is formed between the respective fluorescent layers 44 to enhance the contrast. Further, a metal reflecting film 46 made of aluminum or the like is formed on the fluorescent layer 44 and the optical interception film 43. The metal reflecting film facilitates enhancing the amount of voltage it can withstand and its brightness. Front plate 41, anode 42, optical interception film 43, fluorescent layer 44, and metal reflecting film 46 can be considered a front plate assembly 45.

Figure 2:
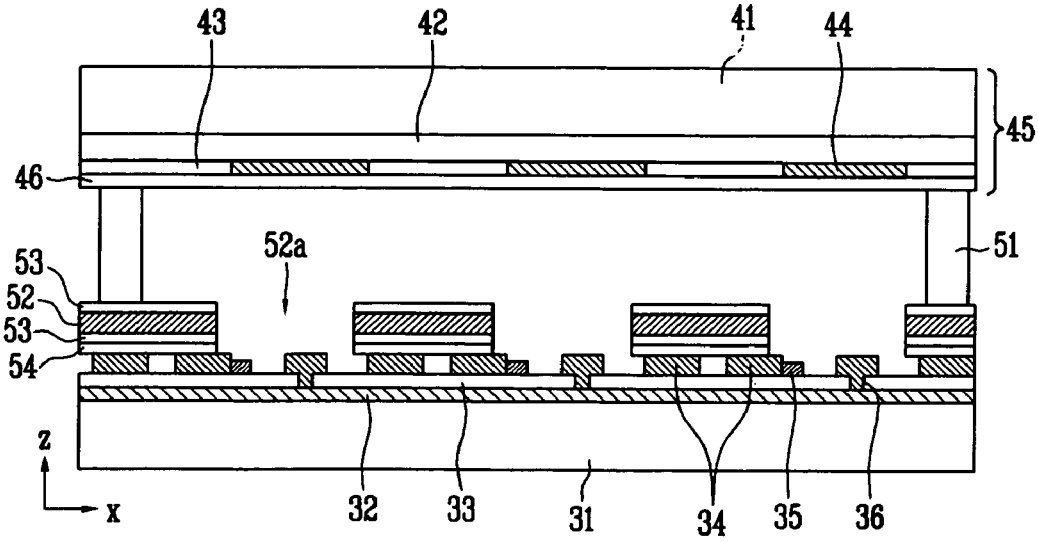
FIG. 2 is a sectional view of an electron emission display having an electron emission device with a grid electrode according to a first embodiment of the present invention.

However, the front plate assembly 45 is not limited to the foregoing configuration illustrated in FIG. 2. The fluorescent layer and the optical interception film may be directly formed on the front plate, and the metal reflecting film may be formed on the fluorescent layer and the optical interception film, wherein the metal reflecting film functions as the anode electrode when high voltage is applied thereto. In this case, because a higher voltage is applied to the metal reflecting film, the brightness is enhanced more than when the transparent electrode is used.

The grid electrode 52 is disposed between the rear plate 31 and the front plate 41, having the hole 52*a*. Further, the grid electrode 52 is formed with a spacer insertion hole 52*b* into which an end of the spacer 51 is inserted. The dielectric film 53 is provided at the top and bottom side of the grid electrode 52, but may be provided only on the bottom sides of the grid electrode 52. The dielectric film 53 is formed over the entire area of the grid electrode 52 as shown in the accompanying drawings, but may be formed only at a predetermined area where the grid electrode 52 and the cathode electrode 34 meet. The grid electrode 52 covered with the dielectric film 53 is attached to the rear plate assembly by the frit 54. That is, the grid electrode 52 is attached to the cathode electrode 34 and/or the dielectric layer 33.

Contrary to the conventional electron emission display having the grid electrode attached to the spacer, the electron emission display according to an embodiment of the present invention includes the grid electrode 52 which is covered with the dielectric film 53 and directly attached to the rear plate assembly by the frit 54, so that the grid electrode 52 is prevented from twisting during the annealing process and prevented from sagging due to its own weight.

The electron emission display according to an embodiment of the present invention operates as follows. When predetermined voltage is applied between the cathode electrode 34 and the gate electrode 32, the electrons are emitted from the electron emitter 35 by a quantum tunneling effect. Then, the electrons are accelerated toward the anode electrode 42 by a voltage of the anode electrode 42 higher than the voltage applied between the cathode electrode 34 and the gate electrode 32, thereby colliding with the fluorescent layer 44 formed on the anode electrode 42. As a result, the electrons of the atoms in the fluorescent layer 44 are put in an excited state, so that the fluorescent layer 44 emits light when the excited fluorescent layer electrons fall to a lower energy state.

Figure 3:
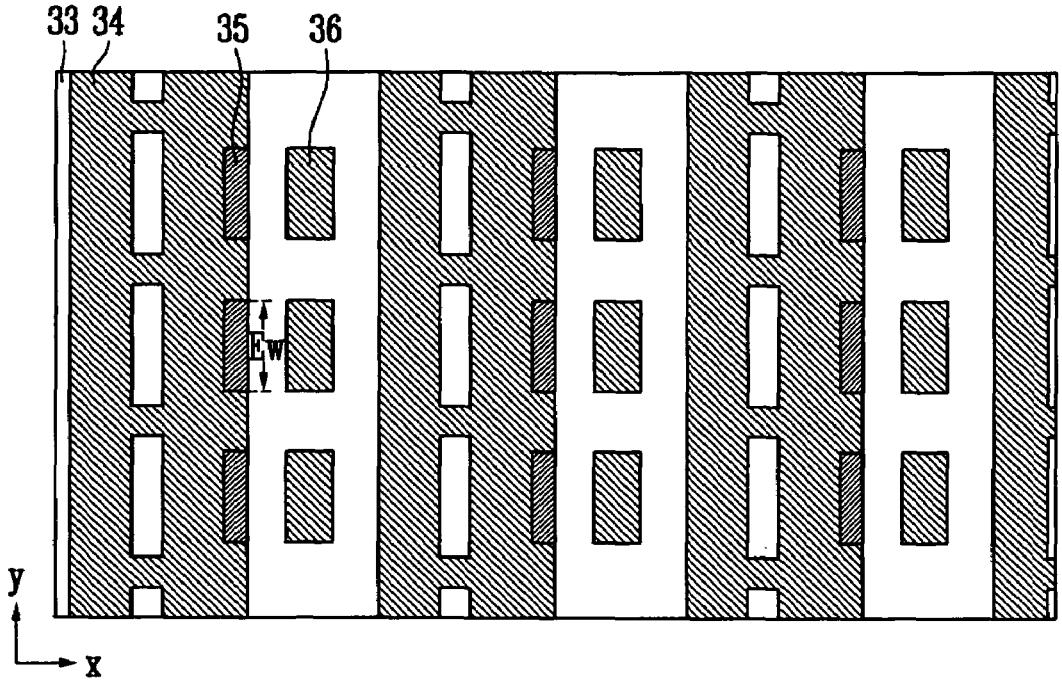
FIG. 3 is a plan view of the electron emission device employed in the electron emission display of FIG. 2.
Figure 5:
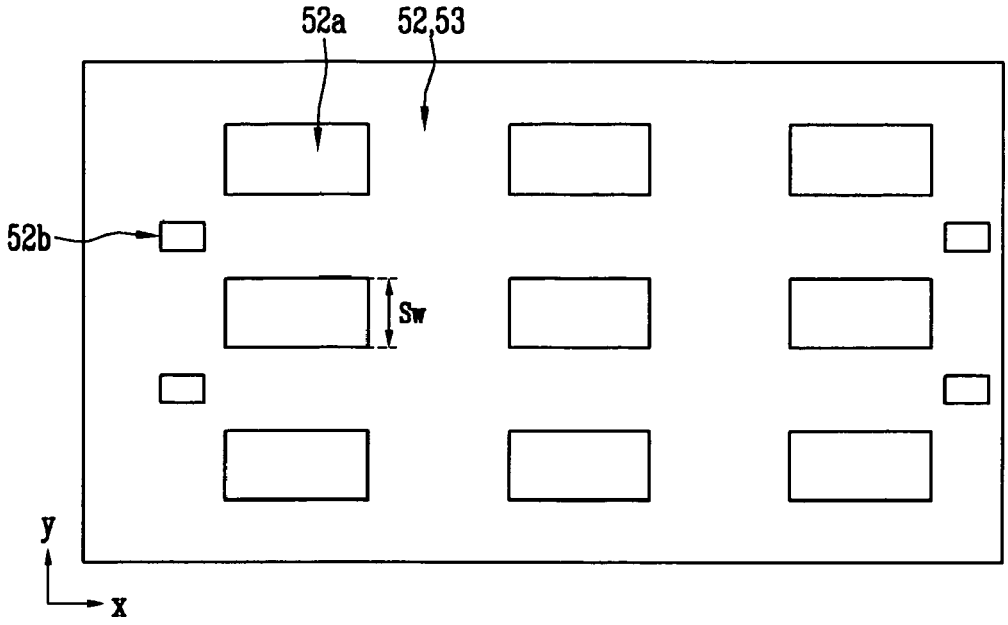
FIG. 5 is a plan view of the grid electrode employed in the electron emission display of FIG. 2.

In the foregoing electron emission display, the grid electrode 52 focuses the electrons emitted from the electron emitter 35, thereby preventing the electrons from colliding with an area adjacent to the fluorescent layer and not with the target area. In the case where the horizontal hole width "Sw" of the grid electrode 52 (as shown in FIG. 5) is much narrower than the horizontal width "Ew" of the electron emitter 35 (as shown in FIG. 3), most electrons would be intercepted by the grid electrode 52 and only a few electrons would arrive at the fluorescent layer 44. In this case, brightness would be decreased because the fluorescent layer 44 emits light only in small quantities. On the other hand, in the case where the horizontal hole width "Sw" of the grid electrode 52 is much larger than the horizontal width "Ew" of the electron emitter 35, the electrons emitted from the electron emitter 35 would not be focused toward the target area of the fluorescent layer 44 and would partially collide with the adjacent irrelevant area of the fluorescent layer 44. In this case, the irrelevant area of the fluorescent layer 44 would emit light, so that the color purity would be decreased. Thus, a ratio of the horizontal hole width "Sw" of the grid electrode 52 to the horizontal width "Ew" of the electron emitter 35 is an important factor affecting the overall performance of the electron emission display.

Figure 6:
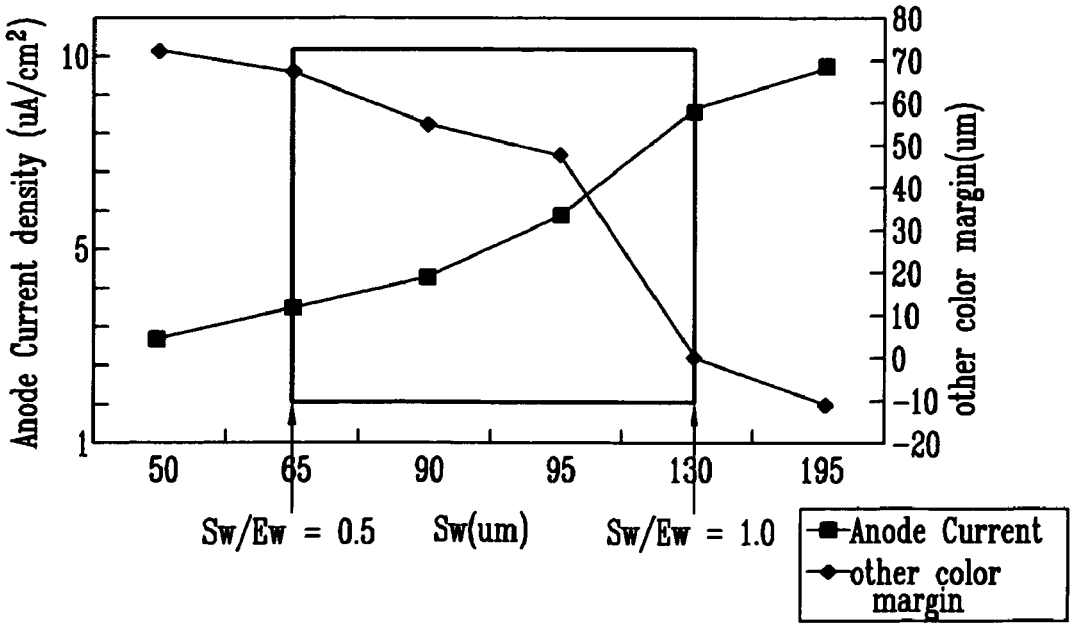
FIG. 6 is a graph showing an experimental result of an anode current density variation and an other color margin variation corresponding to a ratio of the horizontal hole width Sw of the grid electrode to the horizontal width Ew of an electron emitter.

Now, the performance of the electron emission display using the electron emission device according to the first embodiment of the present invention will be described with reference to the FIG. 6 graph showing an experimental result of both an anode current density variation and another color margin variation corresponding to the ratio of horizontal hole width "Sw" of the grid electrode to the horizontal width "Ew" of an electron emitter. Here, the anode current density variation and the other color margin variation are measured, varying the horizontal hole width "Sw" from 50 μm to 195 μm with respect to the horizontal width "Ew" of 128 μm. The cathode electrode has an area of 70 $cm^2$ and is applied with a voltage of −80V. Further, the anode electrode is applied with a voltage of 4 kV. Also, each of the gate electrode and the grid electrode is applied with a voltage of 70V.

Here, the anode current means an electric current flowing in the anode electrode, that is, the electric current generated as the electrons are emitted from the electron emitter connected to the cathode electrode and enter the anode electrode after colliding with the fluorescent layer. The anode current is an important factor affecting the brightness of the electron emission display, so that large and small densities of the anode current mean high brightness and low brightness, respectively. The electron emission display needs an anode current density of 3.5 $\mu A/cm^2$ or more.

The other color margin is an important factor affecting the color purity and means the distance from an area at which the emitted electrons do not arrive to the irrelevant fluorescent area adjacent to the target area. In the case where the other color margin is small, the electrons emitted from the electron emitter are likely to collide with the adjacent irrelevant fluorescent area, so that other color light is emitted, thereby deteriorating the color purity. On the other hand, in the case where the other color margin is large, the electrons emitted from the electron emitter collide with only the target area of the fluorescent layer, thereby enhancing the color purity. The electron emission display is required to have the other color margin of 0 μm or more.

When the ratio of the horizontal hole width "Sw" of the grid electrode to the horizontal width "Ew" of the electron emitter, that is, the ratio of Sw/Ew is equal to or more than about 0.5 and equal to or less than about 1.0, both the anode current density and the other color margin are satisfied. In an exemplary embodiment, when the ratio of Sw/Ew is 0.69-1.0, both the anode current density and the other color margin are satisfied. If the ratio of Sw/Ew is less than the 0.5, the anode current density is lowered, thereby decreasing the brightness of the electron emission display. If the ratio of Sw/Ew is more than 1.0, the other color margin is decreased, thereby deteriorating the color purity of the electron emission display. On the other hand, in the case where the ratio of Sw/Ew is equal to or over than about 0.5 and equal to or less than about 1.0, both the anode current density and the other color margin are suitable for the electron emission display.

The electron emission device according to the first embodiment of the present invention and the electron emission display using the same will now be described in more detail with reference to FIGS. 2, 4, 5, and 7 through 12. First, a process of fabricating the electron emission device will now be described with reference to FIGS. 7 through 12.

Figure 7:
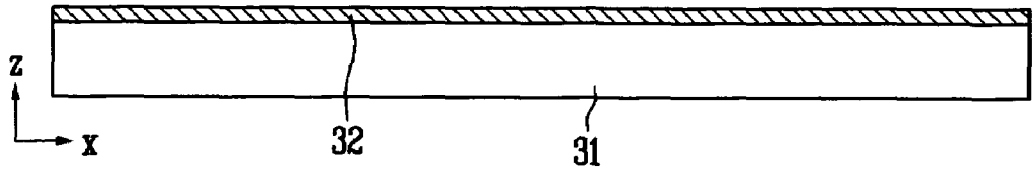
FIGS. 7, 8, 9, 10, 11 and 12 are views illustrating a fabricating process of the electron emission device employed in the electron emission display of FIG. 2.
Figure 8:
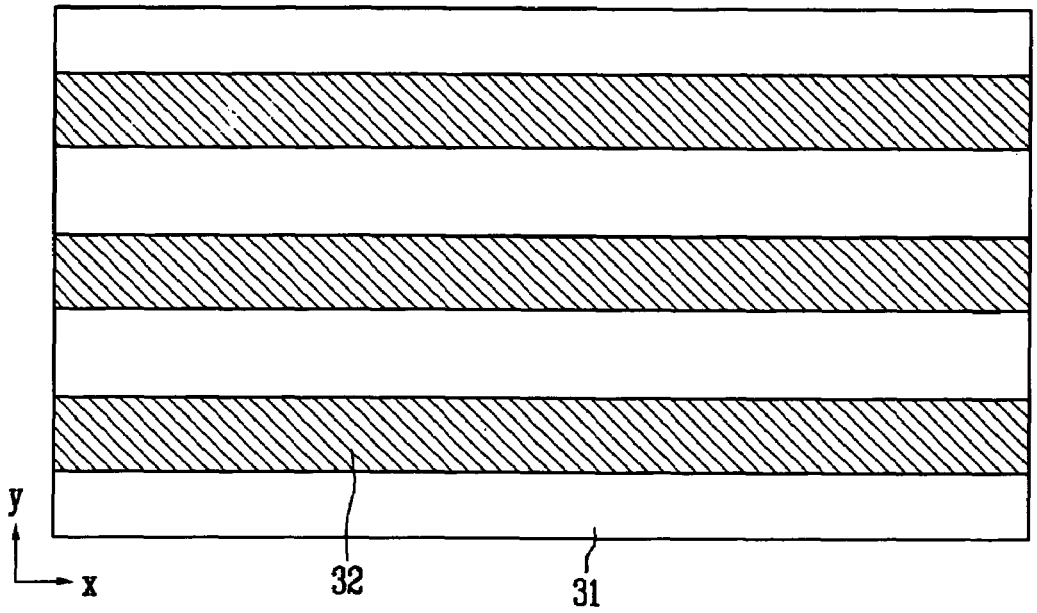

Referring to FIGS. 7 and 8, the gate electrode 32 is formed on the rear plate 31, having a stripe pattern along an x-axis direction. Here, a glass plate can be employed as the rear plate 31. Further, a transparent ITO electrode can be employed as the gate electrode 32, wherein the gate electrode 32 is patterned by a thick film printing method using ITO paste or by patterning the ITO after deposition.

Figure 9:
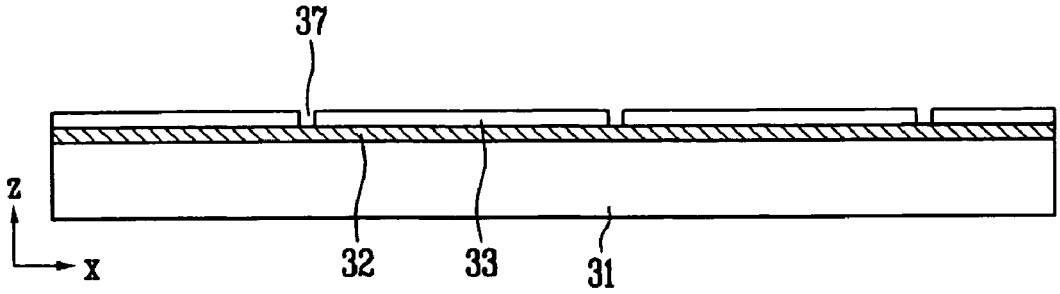
Figure 10:
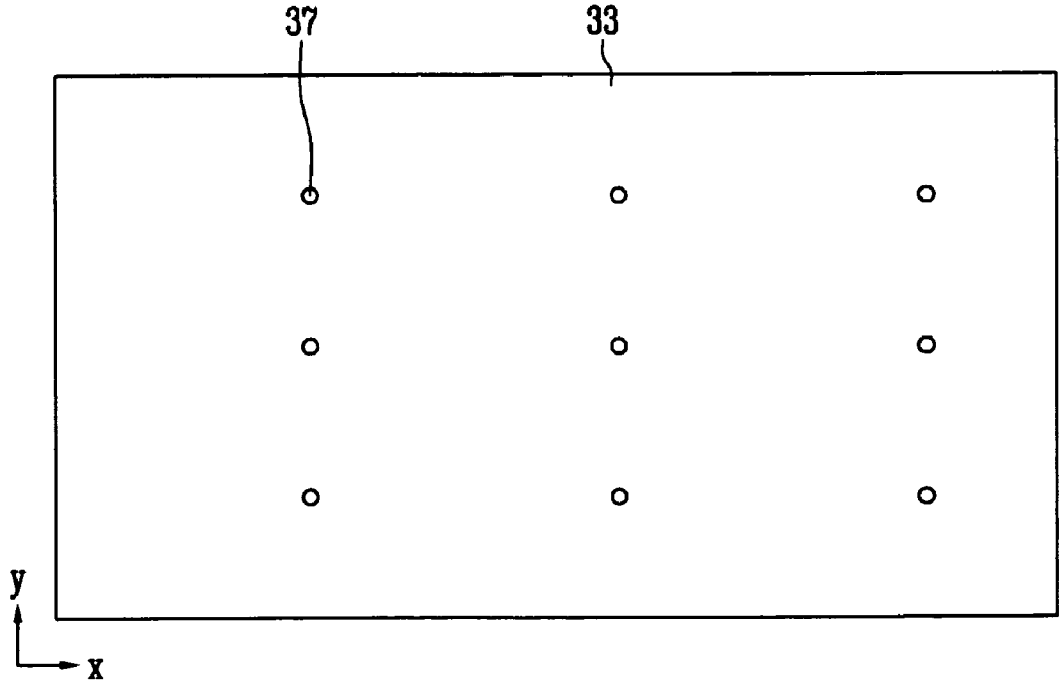

Referring to FIGS. 9 and 10, the dielectric layer 33 having holes 37 is formed. The dielectric layer 33 is applied to the gate electrode 32 on the rear plate 31 by a thick film printing method and is then dried and annealed. Thereafter, the dielectric layer 33 is etched through a photolithography process and an etching process, thereby forming hole 37 through which the gate electrode 32 is partially exposed.

Figure 11:
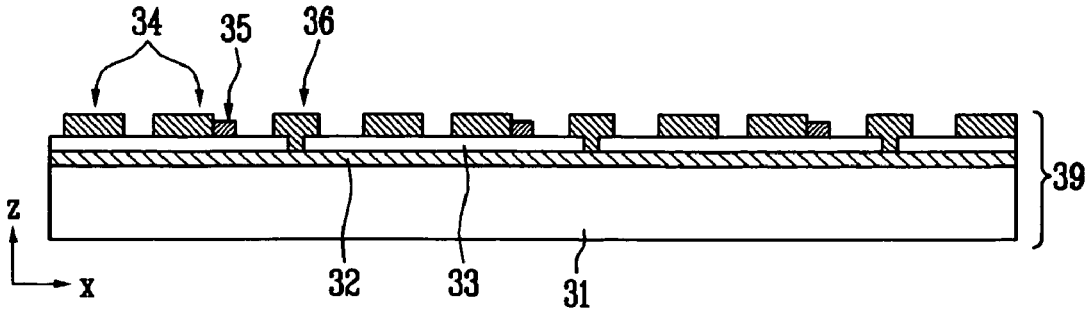
Figure 12:
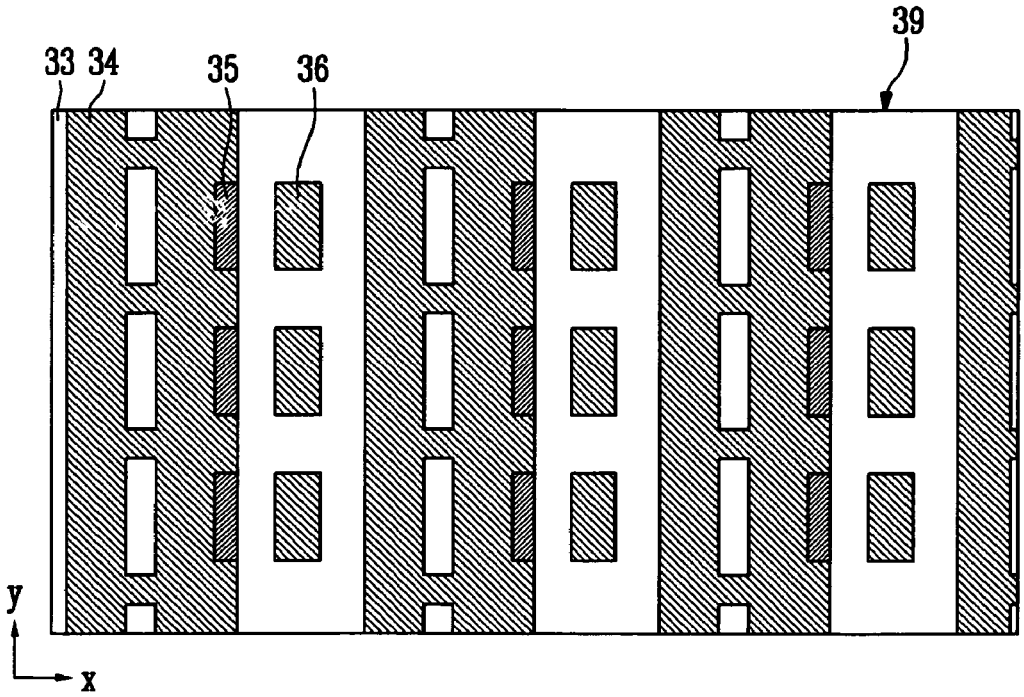

Now referring to FIGS. 11 and 12, a metal layer is deposited and patterned, thereby forming the cathode electrode 34. A portion of the metal layer is removed at an area to be formed with the electron emitter 35 in the following process. The electron emitter 35 connected to the cathode electrode 34 may be the CNT. To form the electron emitter 35 using the CNT, the CNT is applied by a thick film printing method and is then dried. Thereafter, the CNT is removed through rear exposure and development except for the CNT placed at the area to be formed with the electron emitter 35. At this point a rear plate assembly 39 may be considered as being formed.

Figure 4:
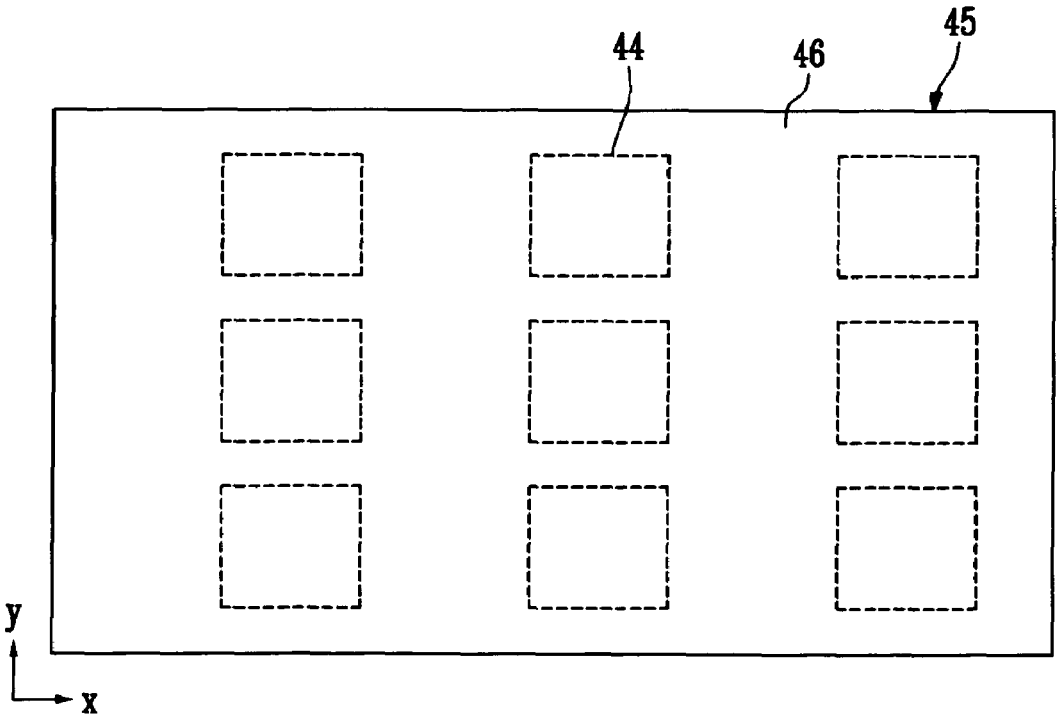
FIG. 4 is a plan view of a front plate employed in the electron emission display of FIG. 2.

A process of forming the front plate assembly will now be described with reference to FIGS. 2 and 4. The anode electrode 42 is formed on the front plate 41. Here, a transparent electrode such as indium tin oxide (ITO), which has excellent optical transmitivity, can be employed as the anode electrode 42. Then, the fluorescent layer 44 and the optical interception film 43 are formed on the anode electrode 42. The fluorescent layer 44 includes red, green and blue fluorescent layers. The red, green and blue fluorescent layers are in turn arranged as a stripe or matrix shape, leaving a predetermined space in between. Further, the optical interception film 43 is formed between the respective fluorescent layers 44 to enhance a contrast. Additionally, a metal reflecting film (not shown) made of aluminum or the like may be formed on both the fluorescent layer 44 and the optical interception film 44. The metal reflecting film facilitates enhancing the amount of voltage it can withstand and its brightness.

Further, the fluorescent layer and the optical interception film may be directly formed on the front plate, and the metal reflecting film is formed on the fluorescent layer and the optical interception film, wherein the metal reflecting film functions as the anode electrode when high voltage is applied thereto. In this case, because the higher voltage is applied to the metal reflecting film, the brightness is enhanced more than when the transparent electrode is employed as the anode electrode on the front plate.

A process of forming the grid electrode will now be described with reference to FIG. 5. The grid electrode 52 can be made of stainless steel, such as Sus steel or Invar steel. The thermal expansion coefficient of the Invar steel is much lower than that of the Sus steel, so that it is effective in decreasing thermal stress arising during the following annealing process. The grid electrode 52 is patterned to have holes 52*a* corresponding to the color areas of the fluorescent layer 44 one by one. Further, the grid electrode 52 is formed with the spacer insertion hole 52*b* into which an end of the spacer 51 is inserted.

A process of assembling the rear plate assembly 39, the front plate assembly 45, the spacer 51 and the grid electrode 52 will now be described with reference to FIG. 2. The frit 54 is applied to the back of the grid electrode 52 covered with the dielectric layer 53, and then the grid electrode 52 is aligned on the rear plate 31, wherein the grid electrode 52 is attached to the cathode electrode 34 at a portion where the frit 54 is applied to. Then, the spacer 51 of which an end is applied with the frit 54 is inserted in the spacer insertion hole 52*b*. Then, the frit 54 is annealed, thereby attaching the grid electrode 52 and the spacer 51 to the cathode electrode 34 and the grid electrode 52, respectively. Thereafter, components of the rear plate assembly 39, of the front plate assembly 45, and therebetween, are packaged, thereby completing the electron emission display.

In the foregoing embodiments, the electron emission display includes the gate electrode, the cathode electrode, and the counter electrode on the rear plate, but not limited to such embodiments and may have various structures as long as it allows the electrons to be emitted from the electron emitter and to collide with the fluorescent layer formed on the front plate.

As described above, the present invention provides an electron emission device with a grid electrode and an electron emission display of an under gate structure having the same, in which the grid electrode is attached to a rear plate assembly such no twisting or sagging occurs, thereby satisfying the desired brightness and color purity levels.

Although exemplary embodiments of the present invention have been shown and described, those skilled in the art would appreciate that changes may be made in the embodiments without departing from the principles and spirit of the invention, the scope of which is defined in the claims and their equivalents.

What is claimed is:

1. An electron emission device comprising:

a plate;

at least one first electrode on the plate and extending in a first direction;

at least one second electrode, extending in a second direction and insulated from the at least one first electrode;

an electron emitter connected to the at least one second electrode, the electron emitter having an electron emitter width;

a third electrode having a hole through which electrons emitted from the electron emitter pass, the hole having a hole width; and a frit between the third electrode and the second electrode, wherein a ratio of the hole width in the second direction to the electron emitter width in the second direction is equal to or more than about 0.5 and equal to or less than about 1.0, wherein the plate, the at least one first electrode, the at least one second electrode and the electron emitter form a plate assembly, and wherein the frit affixes the third electrode to the plate assembly.

2. The electron emission device according to claim 1, further comprising at least one fourth electrode on a same plane as the second electrode, the at least one fourth electrode being coupled to the at least one first electrode through the insulating layer.

3. The electron emission device according to claim 1, wherein a surface of the third electrode distal from the second electrode is coated with a dielectric layer.

4. The electron emission device according to claim 1, wherein the third electrode comprises stainless steel.

5. The electron emission device according to claim 1, wherein the third electrode is attached to the second electrode by the frit.

6. The electron emission device according to claim 1, wherein the ratio of the hole width to the electron emitter width is equal to or more than about 0.69 and equal to or less than about 1.0.

7. The electron emission device according to claim 1, further comprising a front plate assembly spaced apart from the plate by a spacer, and wherein the third electrode includes a spacer insertion hole into which an end of the spacer is inserted.

8. An electron emission display comprising:

a first plate;

a second plate spaced apart from the first plate;

a first electrode on the first plate and extending in a first direction;

a second electrode extending in a second direction and insulated from the first electrode;

an electron emitter connected to the second electrode, the electron emitter having an electron emitter width;

a third electrode having a hole through which electrons emitted from the electron emitter pass, the hole having a hole width;

a frit between the third electrode and the second electrode; and an image display assembly having an anode electrode and a fluorescent layer on the second plate, wherein a ratio of the hole width in the second direction to the electron emitter width in the second direction is equal to or more than about 0.5 and equal to or less than about 1.0, wherein the first plate, the first electrode, the second electrode and the electron emitter form a plate assembly, and wherein the frit affixes the third electrode to the plate assembly.

9. The electron emission display according to claim 8, further comprising a fourth electrode on a same plane as the second electrode, the fourth electrode being coupled to the first electrode through the insulating layer.

10. The electron emission display according to claim 9, further comprising an optical interception film on an inner surface of the second plate.

11. The electron emission display according to claim 9, further comprising a metal reflecting film on an inner surface of the second plate.

12. The electron emission display according to claim 9, wherein a surface of the third electrode distal from the second electrode is coated with a dielectric layer.

13. The electron emission display according to claim 9, wherein the third electrode comprises stainless steel.

14. The electron emission display according to claim 9, wherein the third electrode is attached to the second electrode by the frit.

15. The electron emission display according to claim 9, wherein the ratio of the hole width to the electron emitter width is equal to or more than about 0.69 and equal to or less than about 1.0.

16. The electron emission device according to claim 9, further comprising a spacer spacing the first plate apart from the second plate.

17. The electron emission device according to claim 9, wherein the third electrode includes a spacer insertion hole into which an end of a spacer is inserted.

* * * * *